US012339059B2

(12) United States Patent
Malausa et al.

(10) Patent No.: US 12,339,059 B2
(45) Date of Patent: Jun. 24, 2025

(54) TEMPERATURE-CONTROLLED DRAWER IN A REFRIGERATOR

(71) Applicant: Electrolux Home Products, Inc., Charlotte, NC (US)

(72) Inventors: Andrea Malausa, Veneto (IT); Matteo Simioni, Veneto (IT)

(73) Assignee: Electrolux Consumer Products, Inc., Charlotte, NC (US)

( * ) Notice: Subject to any disclaimer, the term of this patent is extended or adjusted under 35 U.S.C. 154(b) by 459 days.

(21) Appl. No.: 17/708,754

(22) Filed: Mar. 30, 2022

(65) Prior Publication Data

US 2022/0221219 A1 Jul. 14, 2022

Related U.S. Application Data

(63) Continuation-in-part of application No. 16/856,484, filed on Apr. 23, 2020, now Pat. No. 11,578,907.

(51) Int. Cl.
*F25D 29/00* (2006.01)
*F25D 25/02* (2006.01)

(52) U.S. Cl.
CPC ..... *F25D 29/00* (2013.01); *F25D 25/025* (2013.01)

(58) Field of Classification Search
CPC ..... F25D 25/025
See application file for complete search history.

(56) References Cited

U.S. PATENT DOCUMENTS 5,918,480 A 7/1999 Nagata et al.
6,343,477 B1 2/2002 Mandal et al.
6,463,752 B2 10/2002 Mandal et al.
6,880,949 B2 4/2005 Miozza et al.
7,288,326 B2 * 10/2007 Elzey ..... E04C 2/3405 428/179
7,296,769 B2 * 11/2007 Hogenson ..... B64G 1/402 244/171.7
7,763,272 B2 * 7/2010 Offermann ..... A61L 27/3847 424/426

(Continued)

FOREIGN PATENT DOCUMENTS

CN 1987311 6/2007
CN 106895655 6/2017

(Continued)

OTHER PUBLICATIONS

International Search Report for PCT/US2021/018958, dated Jun. 11, 2021, 3 pages.

(Continued)

*Primary Examiner* — Filip Zec

(74) *Attorney, Agent, or Firm* — Chrisman Gallo Tochtrop LLC

(57) ABSTRACT

A refrigerator including a controller for controlling a cooling system of the refrigerator. The controller configured to have at least two modes, wherein in a first mode the controller controls the cooling system to achieve a desired temperature within a fresh food compartment without respect to a temperature in a temperature-controlled drawer, and in a second mode the controller controls the cooling system to achieve a desired temperature within the temperature-controlled drawer without respect to the temperature in the fresh food compartment.

20 Claims, 4 Drawing Sheets

(56) References Cited

U.S. PATENT DOCUMENTS

| | | | | |
|---|---|---|---|---|
| 7,954,301 | B2 * | 6/2011 | Mills | F16L 59/065 52/788.1 |
| 8,966,926 | B2 | 3/2015 | Eveland et al. | |
| 9,115,929 | B2 * | 8/2015 | Han | F25D 11/00 |
| 9,140,486 | B2 | 9/2015 | Wimbert | |
| 9,377,578 | B2 | 6/2016 | Gooden | |
| 9,534,825 | B2 | 1/2017 | Eveland et al. | |
| 9,585,474 | B2 * | 3/2017 | Haltmeyer | A47B 88/49 |
| 9,845,986 | B2 | 12/2017 | Sankhgond | |
| 9,927,167 | B2 | 3/2018 | Eveland et al. | |
| 9,944,452 | B1 * | 4/2018 | Mills | B65D 81/3813 |
| 10,302,353 | B2 | 5/2019 | Uchida et al. | |
| 10,408,378 | B2 * | 9/2019 | Fiedler | B33Y 80/00 |
| 10,520,246 | B2 * | 12/2019 | Choi | A47B 88/457 |
| 11,408,669 | B2 * | 8/2022 | Yang | F25D 11/02 |
| 2007/0104841 | A1 | 5/2007 | Min et al. | |
| 2014/0028172 | A1 | 1/2014 | Min et al. | |
| 2014/0145579 | A1 | 5/2014 | Anderson et al. | |
| 2017/0191731 | A1 | 7/2017 | Djerekarov et al. | |
| 2018/0080702 | A1 | 3/2018 | Wilson | |
| 2018/0080703 | A1 | 3/2018 | Wilson | |
| 2019/0186816 | A1 | 6/2019 | Hwang et al. | |
| 2019/0186817 | A1 | 6/2019 | Hwang et al. | |

FOREIGN PATENT DOCUMENTS

| | | | |
|---|---|---|---|
| CN | 110595150 | | 12/2019 |
| EP | 0849553 | A2 | 6/1998 |
| EP | 1314940 | | 7/2006 |
| EP | 1887298 | | 2/2008 |
| EP | 3339783 | | 6/2018 |
| JP | 2008164266 | | 7/2008 |
| KR | 20140088720 | | 7/2014 |
| WO | WO2006/011099 | A1 | 2/2006 |
| WO | WO2009/099441 | A1 | 8/2009 |

OTHER PUBLICATIONS

International Search Report and Written Opinion for PCT/US2023/015165, dated Jun. 26, 2023, 15 pages.

* cited by examiner

TEMPERATURE-CONTROLLED DRAWER IN A REFRIGERATOR

CROSS-REFERENCE TO RELATED APPLICATIONS

This application is a continuation-in-part of U.S. application Ser. No. 16/856,484 filed on Apr. 23, 2020. This application is incorporated herein by reference.

FIELD OF THE INVENTION

The invention is related to a temperature-controlled drawer in a refrigerator.

BACKGROUND OF THE INVENTION

Conventional refrigeration appliances, such as domestic refrigerators, typically have both a fresh food compartment and a freezer compartment or section. The fresh food compartment is where food items, such as fruits, vegetables, and beverages, are stored. The freezer compartment is where food items that are to be kept in a frozen condition are stored. Refrigerators are provided with refrigeration systems that maintains the fresh food compartment at temperatures above 0° C., such as between 0.25° C. and 4.5° C. and the freezer compartments at temperatures below 0° C., such as between 0° C. and −20° C.

The arrangements of the fresh food and freezer compartments with respect to one another in such refrigerators vary. For example, in some cases, the freezer compartment is located above the fresh food compartment and in other cases the freezer compartment is located below the fresh food compartment. Additionally, many modern refrigerators have their freezer compartments and fresh food compartments arranged in a side-by-side relationship. Whatever arrangement of the freezer compartment and the fresh food compartment is employed, typically, separate access doors are provided for the compartments so that either compartment can be accessed without exposing the other compartment to the ambient air.

Typically, a controlled temperature drawer inside the fresh food compartment is used to best preserve different types of food at an optimum temperature. This temperature-controlled drawer may be located in the fresh food (FF) cavity of the refrigerator and may take cold air from the refrigerator or the cooling ducts. Different temperature settings can be provided depending on the items to be stored in the drawer.

The controlled temperature drawer can be used to store deli trays, fresh meat, leftovers, beverages or other food items that, for an optimum storage, require different (e.g., colder) temperatures than what is usually present inside the overall fresh food cavity. Usually, the controlled temperature drawer is not to be used for vegetables.

SUMMARY OF THE INVENTION

A refrigerator including a fresh food compartment for storing food. The fresh food compartment includes a temperature sensor disposed therein. A temperature-controlled drawer is positioned within the fresh food compartment. The temperature-controlled drawer includes a display including a plurality of lights each indicative of a different storage temperature for the temperature-controlled drawer. An input device is provided for allowing a user to selectively illuminate the plurality of lights. The temperature-controlled drawer is configured to have a temperature that is a predetermined temperature differential from a temperature in the fresh food compartment during steady state operation of the refrigerator. A cooling system is configured for introducing cold air into the fresh food compartment. A controller is provided for controlling the cooling system of the refrigerator. The controller is configured to have at least two modes, wherein in a first mode the controller controls the cooling system to achieve a desired temperature within the fresh food compartment without respect to the temperature in the temperature-controlled drawer, and in a second mode the controller controls the cooling system to achieve a desired temperature within the temperature-controlled drawer without respect to the temperature in the fresh food compartment.

In the refrigerator, the temperature-controlled drawer may be free of a temperature sensor.

In the refrigerator, a flow path for cold air flowing to temperature-controlled drawer may be free of a damper or other flow controlling device.

In the refrigerator, the controller may be disposed in the refrigerator.

In the refrigerator, the predetermined temperature differential may be about 0° C. to about 2° C.

In the refrigerator, the controller may be configured to transition to the second mode based on actuation of the input device.

In the refrigerator, the controller may be configured to remain in the second mode for a predetermined period of time.

In the refrigerator, the controller may be configured to transition from the second mode to the first mode based on receipt of a command from a user.

In the refrigerator, the command from the user may be a selection of a desired temperature for the fresh food compartment.

In the refrigerator, the controller may be configured to remain in the first mode for an indefinite period of time.

In the refrigerator, each of the plurality of lights may be a different color.

In the refrigerator, the plurality of lights may include a first light corresponding to a deli temperature, a second light corresponding to a dairy temperature and a third light corresponding to a meat temperature for the temperature-controlled drawer.

There is also provided a method for controlling operation of a refrigerator. The refrigerator including a fresh food compartment for storing food. A temperature sensor is disposed in the fresh food compartment. A temperature-controlled drawer is positioned within the fresh food compartment. A cooling system is configured for introducing cold air into the fresh food compartment. A controller is provided for controlling the cooling system of the refrigerator. The method including operating the controller in a first mode wherein the controller is configured to control the cooling system to achieve a desired temperature within the fresh food compartment without respect to a temperature in the temperature-controlled drawer, and upon actuation of an input device, transitioning the controller to a second mode wherein the controller is configured to control the cooling system to achieve a desired temperature within the temperature-controlled drawer without respect to a temperature in the fresh food compartment.

In the method, the temperature-controlled drawer may be configured to have a temperature that is a predetermined temperature differential from a temperature in the fresh food compartment during steady state operation of the refrigerator.

In the method, the predetermined temperature differential may be about 0° C. to about 2° C.

In the method, the controller may transition from the second mode to the first mode after a predetermined period of time.

In the method, the controller may transition from the second mode to the first mode upon command by a user.

In the method, the command from the user may be a selection of a desired temperature for the fresh food compartment.

In the method, the controller may be configured to remain in the first mode for an indefinite period of time.

In the method, actuation of the input device may index a display between a plurality of lights.

DESCRIPTION OF THE DRAWINGS

For the purpose of illustrating the invention, there is shown in the drawings a form that is presently preferred; it being understood, however, that this invention is not limited to the precise arrangements and instrumentalities shown.

DESCRIPTION OF THE INVENTION

Figure 1:
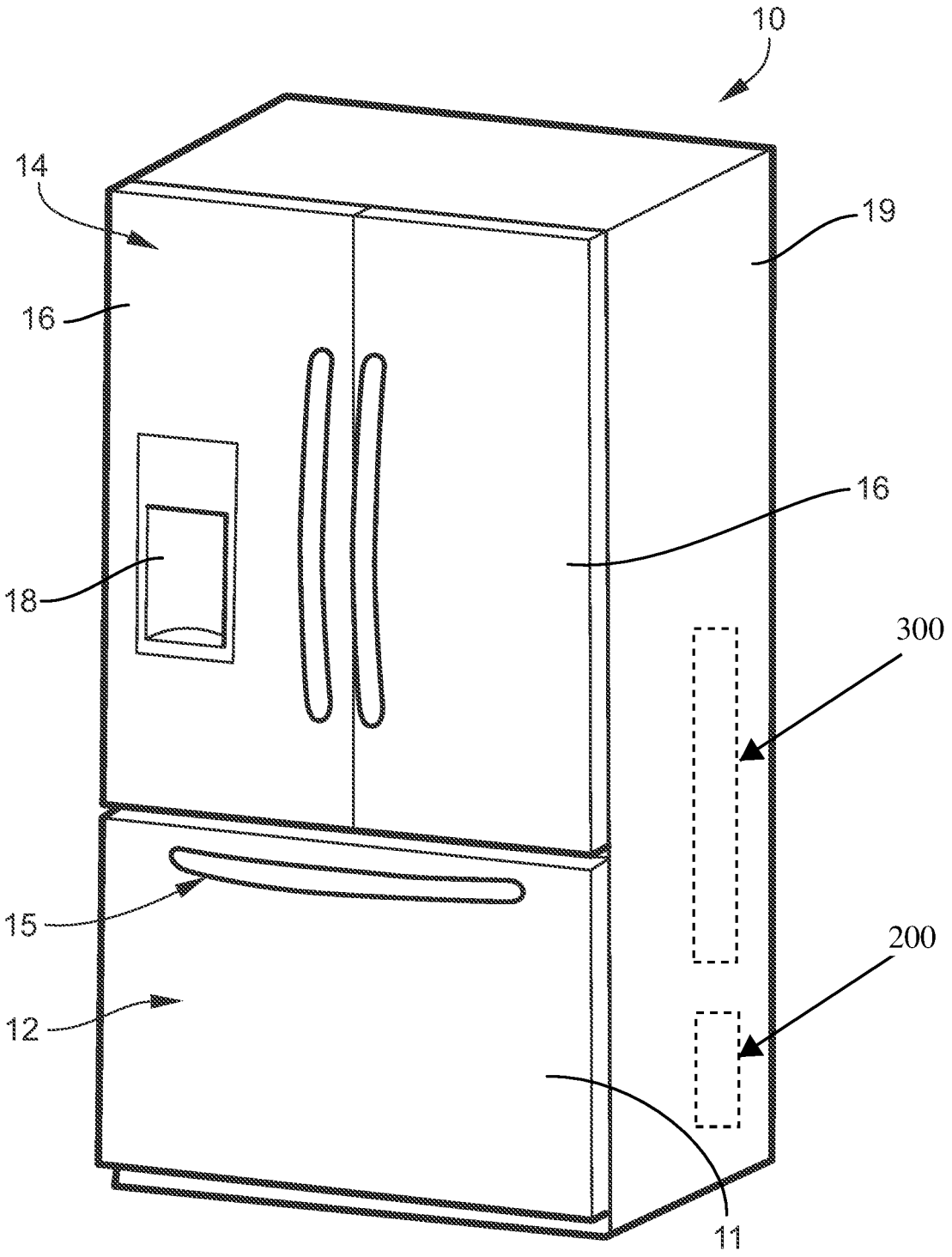
FIG. 1 is a front perspective view of a prior art household French door bottom mount refrigeration appliance showing doors of the fresh food compartment and drawer of a freezer compartment in a closed position.

Referring to the drawings, wherein like elements have like numerals, there is shown in the figures an embodiment, that is currently preferred, of the temperature-controlled drawer 100 for a refrigerator. In general, temperature-controlled drawer 100 includes a display 140, and a light 160 (located on an inside surface of the drawer—not shown).

Figure 2:
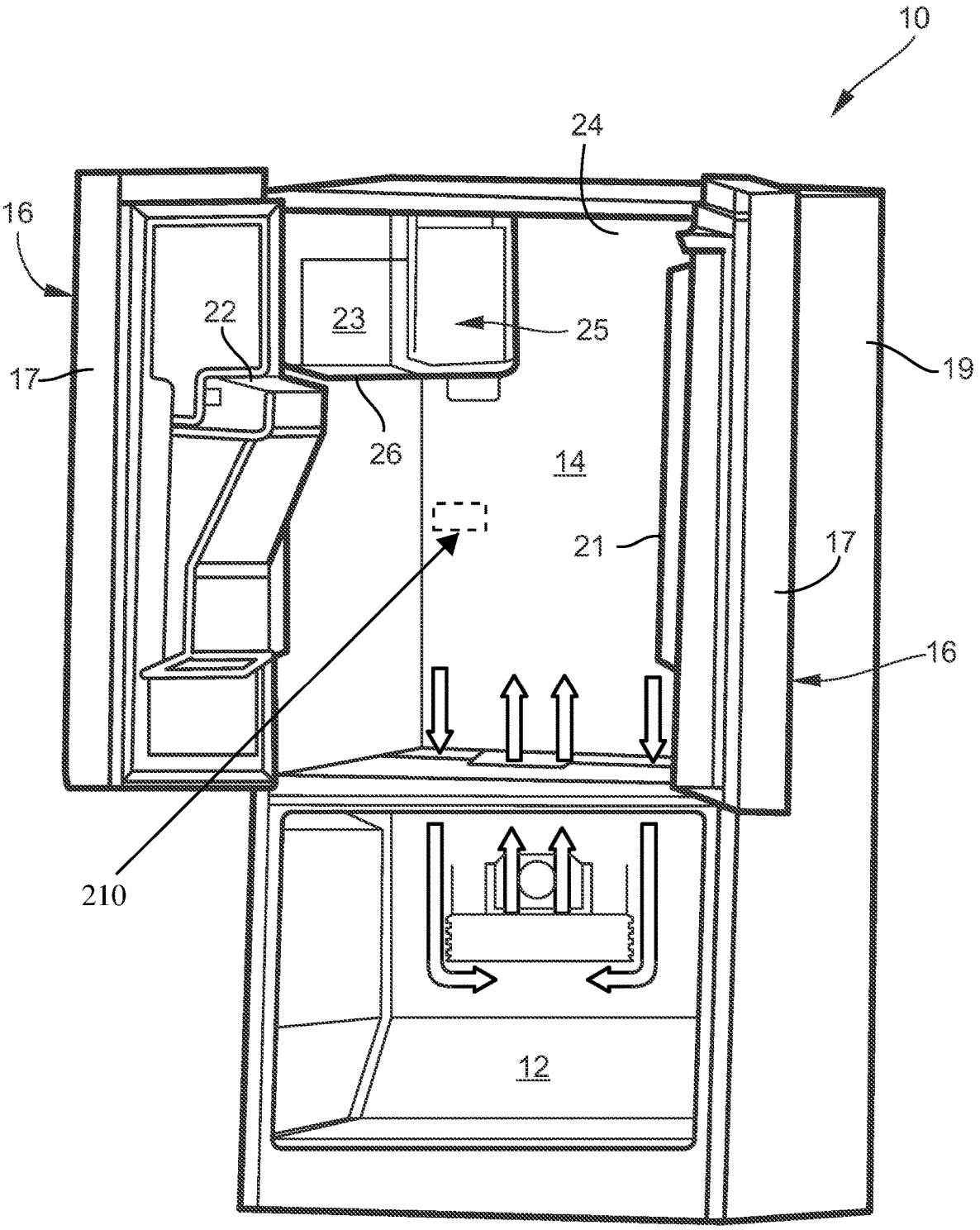
FIG. 2 is a front perspective view of the prior art refrigeration appliance of FIG. 1 showing the doors of the fresh food compartment in opened positions and the drawer of the freezer compartment removed.

Referring now to the drawings, FIGS. 1 and 2 show a refrigeration appliance in the form of a domestic refrigerator, indicated generally at 10. Although the detailed description that follows concerns a domestic refrigerator 10, the invention can be embodied by refrigeration appliances other than a domestic refrigerator 10. An embodiment is described in detail below, and shown in the figures as a bottom-mount configuration of a refrigerator 10, including a fresh food compartment 14 disposed vertically above a freezer compartment 12. However, the refrigerator 10 can have any desired configuration including at least a fresh food compartment 14 and/or a freezer compartment 12, such as a top mount refrigerator (freezer disposed above the fresh food compartment), a side-by-side refrigerator (fresh food compartment is laterally next to the freezer compartment), a standalone refrigerator or freezer, etc.

One or more doors 16 shown in FIG. 1 are pivotably coupled to a cabinet 19 of the refrigerator 10 to restrict and grant access to the fresh food compartment 14. The door 16 can include a single door that spans the entire lateral distance across the entrance to the fresh food compartment 14, or can include a pair of French-type doors 16 as shown in FIG. 1 that collectively span the entire lateral distance of the entrance to the fresh food compartment 14 to enclose the fresh food compartment 14.

For the latter configuration, a center flip mullion 21 (FIG. 2) is pivotally coupled to at least one of the doors 16 to establish a surface against which a seal provided to the other one of the doors 16 can seal the entrance to the fresh food compartment 14 at a location between opposing side surfaces 17 (FIG. 2) of the doors 16. The mullion 21 can be pivotably coupled to the door 16 to pivot between a first orientation that is substantially parallel to a planar surface of the door 16 when the door 16 is closed, and a different orientation when the door 16 is opened. The externally exposed surface of the center mullion 21 is substantially parallel to the door 16 when the center mullion 21 is in the first orientation and forms an angle other than parallel relative to the door 16 when the center mullion 21 is in the second orientation. The seal and the externally exposed surface of the mullion 21 cooperate approximately midway between the lateral sides of the fresh food compartment 14.

A dispenser 18 (FIG. 1) for dispensing at least ice pieces, and optionally water, can be provided on an exterior of one of the doors 16 that restricts access to the fresh food compartment 14. The dispenser 18 includes an actuator (e.g., lever, switch, proximity sensor, etc.) to cause frozen ice pieces to be dispensed from an ice bin 23 (FIG. 2) of an ice maker 25 disposed within the fresh food compartment 14. Ice pieces from the ice bin 23 can exit the ice bin 23 through an aperture 26 and be delivered to the dispenser 18 via an ice chute 22 (FIG. 2), which extends at least partially through the door 16 between the dispenser 18 and the ice bin 23.

The freezer compartment 12 is arranged vertically beneath the fresh food compartment 14. A drawer assembly (not shown) including one or more freezer baskets (not shown) can be withdrawn from the freezer compartment 12 to grant a user access to food items stored in the freezer compartment 12. The drawer assembly can be coupled to a freezer door 11 that includes a handle 15. When a user grasps the handle 15 and pulls the freezer door 11 open, at least one or more of the freezer baskets is caused to be at least partially withdrawn from the freezer compartment 12.

In alternative embodiments, the ice maker is located within the freezer compartment. In this configuration, although still disposed within the freezer compartment, at least the ice maker (and possible an ice bin) is mounted to an interior surface of the freezer door. It is contemplated that the ice mold and ice bin can be separate elements, in which one remains within the freezer compartment and the other is on the freezer door.

The freezer compartment 12 is used to freeze and/or maintain articles of food stored in the freezer compartment 12 in a frozen condition. For this purpose, the freezer compartment 12 is in thermal communication with a freezer evaporator (not shown) that removes thermal energy from the freezer compartment 12 to maintain the temperature therein at a temperature of 0° C. or less during operation of the refrigerator 10, preferably between 0° C. and −50° C., more preferably between 0° C. and −30° C. and even more preferably between 0° C. and −20° C.

The refrigerator 10 includes an interior liner 24 (FIG. 2) that defines the fresh food compartment 14. The fresh food compartment 14 is located in the upper portion of the refrigerator 10 in this example and serves to minimize spoiling of articles of food stored therein. The fresh food compartment 14 accomplishes this aim by maintaining the temperature in the fresh food compartment 14 at a cool temperature that is typically above 0° C., so as not to freeze the articles of food in the fresh food compartment 14. It is contemplated that the cool temperature preferably is between 0° C. and 10° C., more preferably between 0° C. and 5° C. and even more preferably between 0.25° C. and 4.5° C.

According to some embodiments, cool air from which thermal energy has been removed by the freezer evaporator can also be blown into the fresh food compartment 14 to maintain the temperature therein greater than 0° C. preferably between 0° C. and 10° C., more preferably between 0° C. and 5° C. and even more preferably between 0.25° C. and 4.5° C. For alternate embodiments, a separate fresh food evaporator can optionally be dedicated to separately maintaining the temperature within the fresh food compartment 14 independent of the freezer compartment 12.

According to an embodiment, the temperature in the fresh food compartment 14 can be maintained at a cool temperature within a close tolerance of a range between 0° C. and 4.5° C., including any subranges and any individual temperatures falling with that range. For example, other embodiments can optionally maintain the cool temperature within the fresh food compartment 14 within a reasonably close tolerance of a temperature between 0.25° C. and 4° C.

The refrigerator 10 includes a controller 200 (FIG. 1) for receiving input from various sensors and input devices (e.g., a user interface device) and is configured to control the operation of various components of the refrigerator 10 (for example a cooling system 300 (FIG. 1) of the refrigerator 10 that is configured to introduce cold air into the freezer compartment 12 and the fresh food compartment 14 based on those inputs. It is contemplated that the cold air in the fresh food compartment 14 may diffuse into the temperature-controlled drawer 100 via gaps between the temperature-controlled drawer 100 and the fresh food compartment 14 It is contemplated that the controller 200 may be a single control device that is disposed within the refrigerator 10 or a series of interconnected control devices that communicate with each other to control the operation of the refrigerator 10.

Figure 3:
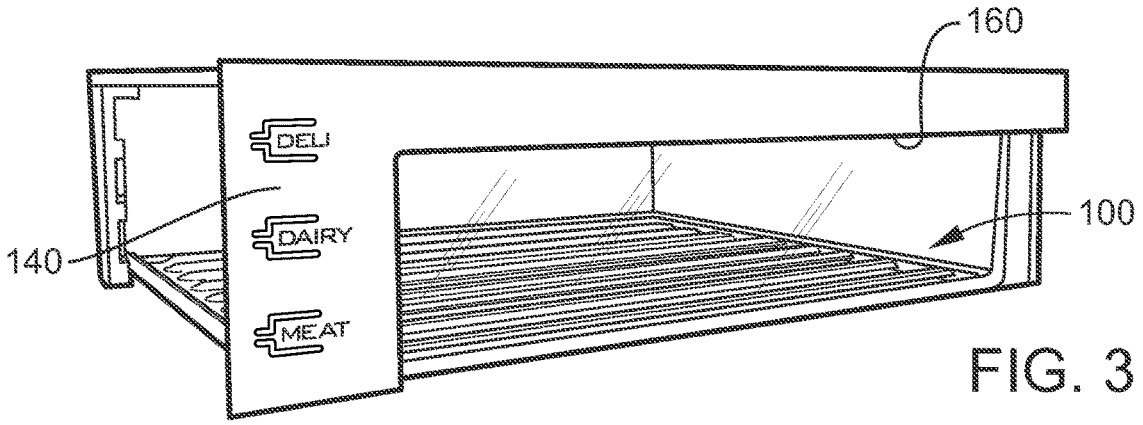
FIG. 3 shows an embodiment of a temperature-controlled drawer.
Figure 4:
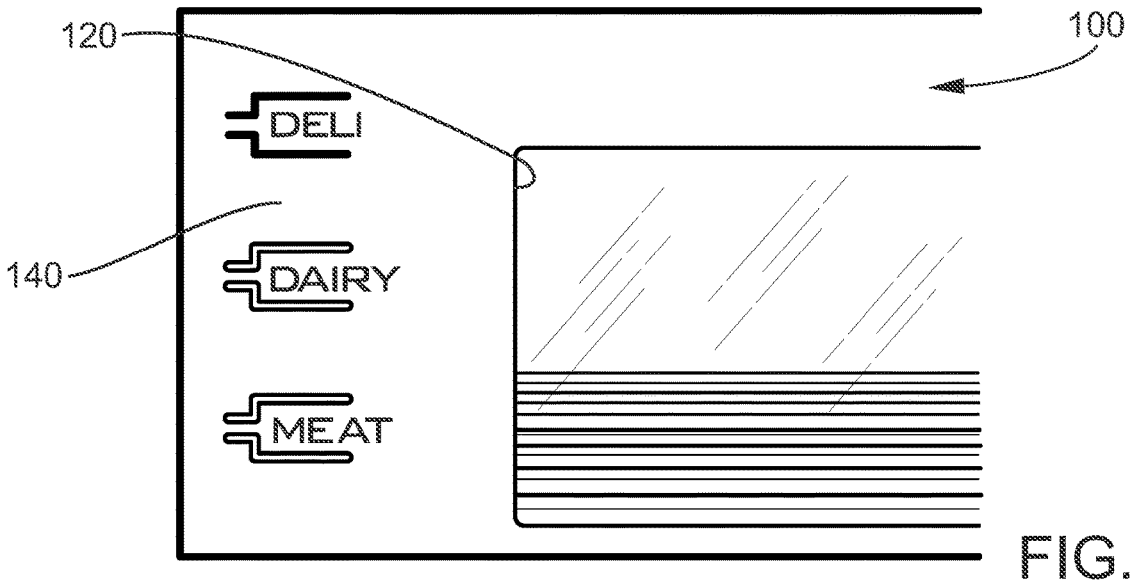
FIG. 4 shows an embodiment of a display of the temperature-controlled drawer.
Figure 5:
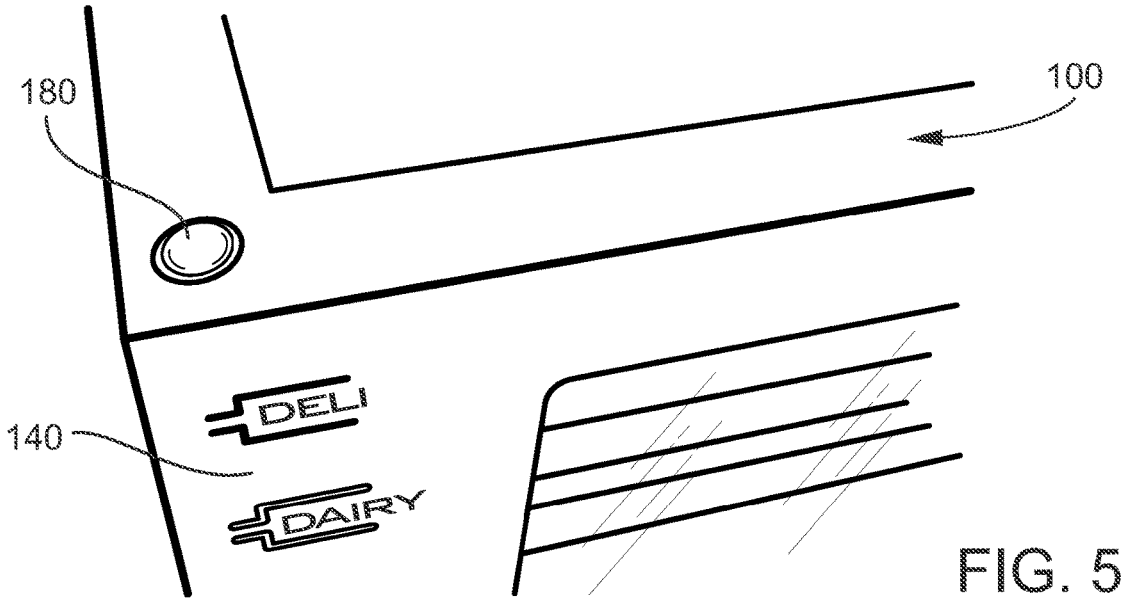
FIG. 5 shows an embodiment of a switch of the temperature-controlled drawer.

Referring now to FIGS. 3, 4, and 5, an embodiment of the temperature-controlled drawer 100, as used herein, refers to, for example, an open container, with or without a lid, slidably mounted within the fresh food compartment 14 of the refrigerator 10. The temperature-controlled drawer 100 is operatively connected to refrigerator 10 to take cold air from the refrigerator or the cooling ducts, as is well known.

In one embodiment, a temperature sensor 120 may be disposed within the temperature-controlled drawer 100 and be any conventional temperature sensor. The sensor 120 may be located within the temperature-controlled drawer 100, for example, on an inside surface thereof. The temperature of the temperature-controlled drawer 100 is influenced primarily by (and/or has a known relationship to) the temperature in the fresh food compartment 14. The sensor 120 only measures the temperature and its output is not used by the controller 200 to directly control the temperature within the temperature-controlled drawer 100. The sensor 120 produces an output signal that is received by the controller 200.

The display 140 may be any display. The display 140 may include lights (e.g., LEDs) to illuminate the interior of the temperature-controlled drawer 100 and/or a LCD display. The display 140 shows three exemplary temperature ranges: Deli, dairy, or meat (these temperature ranges are well known in the art). The output signal from the sensor 120 may be sent to the controller 200 that translates the signal to a temperature (as is well known). The controller 200 may then communicate with the display 140 to cause that temperature by, as shown, activating a light within the temperature-controlled drawer 100 and/or on the display 140. The temperature indicated is the best temperature for the food-type indicated on the display 140 to be stored within the temperature-controlled drawer 100. The controller 200 may operate as follows: the controller 200 receives an output from the temperature sensor 120, determines what food type would be best suited for the temperature within said temperature-controlled drawer 100 based on said temperature sensor output, and indicates via the display 140 what type of food it has determined is best for storage therein. It is contemplated that when the controller 200 determines the temperature in the temperature-controlled drawer 100 is not suitable for any of the foregoing food types, the controller 200 may be configured to cause none of the lights on the display 140 to be illuminated. It is also contemplated that the controller 200 may be configured to cause all the lights on the display 140 to blink at a predetermined interval when the temperature in the temperature-controlled drawer 100 is not suitable for any of the foregoing food types.

A light 160 may be disposed within the temperature-controlled drawer 100 for illuminating the interior of the temperature-controlled drawer 100. The light 160 may be any light source. In one embodiment the light 160 is a LED. The LED may one that emits different colors, based on input (e.g., voltage), as is well known. In one embodiment, the wavelength of the light 160 is chosen based on the temperature, it being understood that some light wavelengths may have properties beneficial to the temperature range, e.g., better bacteria destroying properties for a given temperature range of product stored at that temperature range. The light 160 may be place on an interior surface of the temperature-controlled drawer 100 and/or may be on an exterior surface or part of the temperature-controlled drawer 100. The light 160 is operatively coupled to the display 140, so that the color on the display 140 and the color of the light 160 match. Additionally, the light 160 is activated when the temperature-controlled drawer 100 is open and is extinguished when the temperature-controlled drawer 100 is closed, as is well known. It is further contemplated that the color emitted by the light 160 may be a neutral color, e.g., white, when the controller 200 determines that the temperature in the temperature-controlled drawer 100 is not suitable for any particular food type.

An input device 180, e.g., a button, on the temperature-controlled drawer 100 may be used by the user to change the temperature within the temperature-controlled drawer 100. The input device 180 is operatively connected to the controller 200. Upon receipt of the signal from the input device 180, the controller 200 may control components of the refrigerator to change the temperature within the temperature-controlled drawer 100 to that selected by the user. It is contemplated that the input device 180 may be configured such that repeated actuation of the input device 180 allows the user to index through the preset temperature ranges of the food-type indicated on the display 140, e.g., a deli temperature, a dairy temperature and a meat temperature.

In a second embodiment, a flow path for cold air flowing to the temperature-controlled drawer 100 is free of a flow controlling device (e.g., a damper) and the temperature-controlled drawer 100 is free of a temperature sensor. Instead, a temperature sensor 210 (FIG. 2) may be located within the fresh food compartment 14 for measuring a temperature therein. In this embodiment the temperature-controlled drawer 100 may be configured so that during steady state operation of the refrigerator 10 a difference between the temperature within the temperature-controlled drawer 100 and the temperature within the fresh food compartment 14 may be a predetermined temperature differential. That is, the temperature-controlled drawer 100 may be relatively colder than the fresh food compartment 14 by the predetermined temperature differential. It is contemplated that this predetermined temperature differential may be about 2° C., preferably about 1° C. It is also contemplated that there may be a negligible or insignificant temperature differential between the fresh food compartment 14 and the temperature-controlled drawer 100 during steady state operation of the refrigerator 100. In this embodiment, the predetermined temperature differential may be about 0° C. Regardless of whether there is a predetermined temperature differential or a negligible temperature differential, in this embodiment, it is not required that the temperature-controlled drawer 100 include a temperature sensor because the temperature in the temperature-controlled drawer 100 is generally known based on the temperature in the fresh food compartment 14. In other words, the controller 200 may be configured to use the known temperature in the fresh food compartment 14 and temperature differential between the fresh food compartment 14 and the temperature-controlled drawer 100 (if it is not negligible) to calculate the temperature in the temperature-controlled drawer 100.

Figure 6:
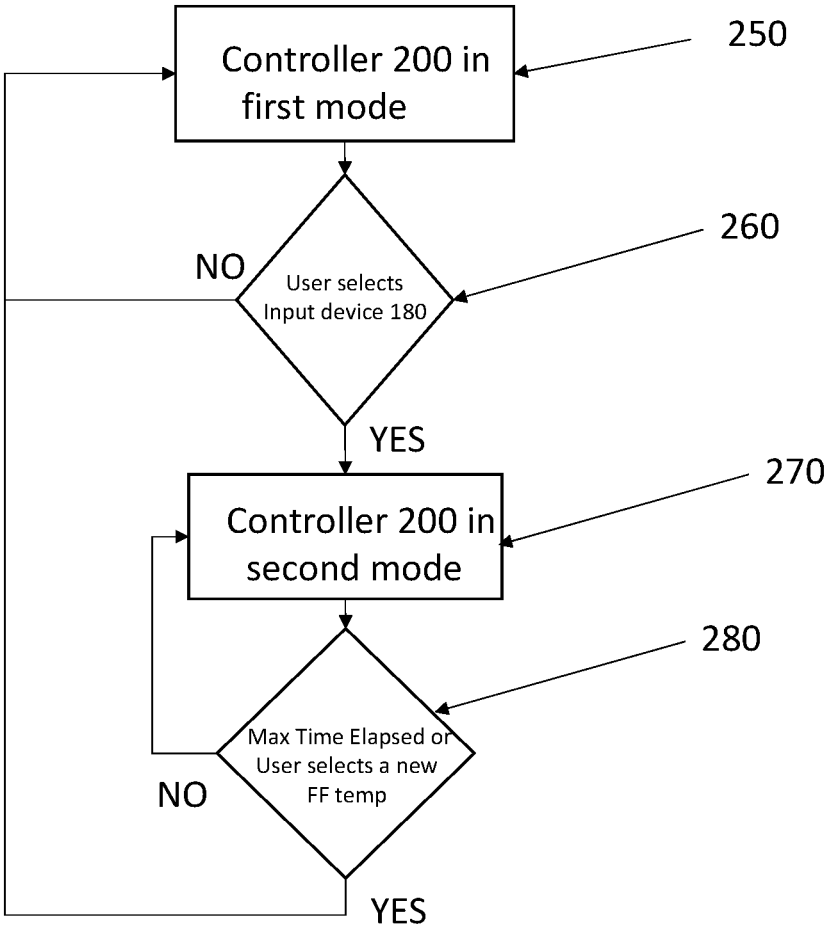
FIG. 6 illustrates a control algorithm for the controller of FIG. 1, according to a second embodiment.

In this embodiment, the controller 200 may be configured to have two different control modes for controlling the temperatures in the fresh food compartment 14 and the temperature-controlled drawer 100. Referring to FIG. 6, initially the controller 200 may be in a first mode (Step 250) wherein the fresh food compartment 14 is the primary control for the cooling system 300, and the temperature-controlled drawer 100 is the secondary control. In the first mode, the controller 200 is programmed to control the temperature within the fresh food compartment 14 based on a user-selected temperature for the fresh food compartment 14. It is understood that this user-selected temperature could be a direct temperature value, i.e., 0.5° C.-4.5° C., or could be an indirect substitute temperature value (low, medium, high or 0-10, etc.). This user-selected temperature may be selected by the user using an input device, e.g., a graphical user interface (GUI) (not shown) or a button on the refrigerator 10. In the first mode, the temperature of the temperature-controlled drawer 100 will achieve a temperature that is offset from the temperature in the fresh food compartment 14 by the predetermined temperature differential (discussed in detail above). The controller 200 is configured to not control the refrigerator 10 to achieve a desired temperature in the temperature-controlled drawer 100. Instead the temperature in the temperature-controlled drawer 100 merely follows the temperature in the fresh food compartment 14.

It is contemplated that the controller 200 may remain in this first mode for an indefinite period of time until the user provides an input that causes the controller 200 to change modes. At Step 260 the controller 200 is programmed to monitor for such inputs. In the present invention, the actuation of the input device 180 by the user causes the controller 200 to change to a second mode (Step 270) wherein the temperature-controlled drawer 100 is the primary control for the cooling system 300, and the fresh food compartment 14 is the secondary control for the cooling system. In the second mode, the controller 200 is programmed to adjust the operation of the refrigerator 10 so that the user selected temperature is achieved in the temperature-controlled drawer 100. Contrary to the first mode wherein the controller 200 is programmed to make adjustments to reach and maintain a desired temperature in the fresh food compartment 14, in the second mode the controller 200 is programmed to make adjustments to reach and maintain a desired temperature in the temperature-controlled drawer 100. In this embodiment, the user selected temperature for the fresh food compartment 14 is not taken into consideration by the controller 200 as it makes adjustments to reach and maintain the requested temperature in the temperature-controlled drawer 100. As there is no temperature sensor in the temperature-controlled drawer 100, the controller 200 uses the temperature sensor 210 and the known predetermined temperature differential to calculate the temperature within the temperature-controlled drawer 100. In this respect, the controller 200 is configured to not control the refrigerator 10 to achieve a desired temperature in the fresh food compartment 14. Instead the temperature in the fresh food compartment 14 merely follows the temperature in the temperature-controlled drawer 100.

In Step 280, the controller 200 is programmed to continue to monitor for the user to input another command (i.e., a cancel command or a re-selection of the fresh food temperature) that will cause the controller 200 to exit the second mode and return to the first mode. It is also contemplated that the controller 200 may be programmed to have a timer that limits the amount of time that the controller 200 stays in the second mode. The timer may be programmed to allow the controller 200 to stay in the second mode for a predetermined period of time that may be on the order of hours, e.g., 2 hours, or days, e.g., 2 days.

It is contemplated that the second mode may be used when the user wishes to store an expensive food item in the temperature-controlled drawer 100 for a short duration of time. In other words, the second mode is intended to be used occasionally for a temporary period of time when the user wishes to store specialty food items within the temperature-controlled drawer 100.

As explained in detail, this embodiment has a first mode wherein the controller 200 controls the cooling system 300 of the refrigerator 10 to achieve and maintain the desired temperature primarily in the fresh food compartment 14, and a second mode wherein the controller 200 controls the cooling system 300 of the refrigerator 10 to achieve and maintain the desired temperature primarily in the temperature-controlled drawer 100.

The present invention may be embodied in other forms without departing from the spirit and the essential attributes thereof, and, accordingly, reference should be made to the appended claims, rather than to the foregoing specification, as indicating the scope of the invention.

We claim:

1. A refrigerator comprising a fresh food compartment for storing food, the fresh food compartment comprising a temperature sensor disposed therein;

a temperature-controlled drawer positioned within the fresh food compartment; the temperature-controlled drawer including:

a display including a plurality of lights each indicative of a different storage temperature for the temperature-controlled drawer, and an input device for allowing a user to selectively illuminate the plurality of lights, wherein the temperature-controlled drawer is configured to have a temperature that is a predetermined temperature differential from a temperature in the fresh food compartment during steady state operation of the refrigerator; and a cooling system configured for introducing cold air into the fresh food compartment; and a controller for controlling the cooling system of the refrigerator, the controller configured to have at least two modes, wherein in a first mode the controller controls the cooling system to achieve a desired temperature within the fresh food compartment without respect to the temperature in the temperature-controlled drawer, in a second mode the controller controls the cooling system to achieve a desired temperature within the temperature-controlled drawer based on the temperature sensor in the fresh food compartment and the predetermined temperature differential, and a flow path for cold air flowing to the temperature-controlled drawer is free of a damper.

2. The refrigerator of claim 1 wherein the temperature-controlled drawer is free of a temperature sensor.

3. A refrigerator comprising:

a fresh food compartment for storing food, the fresh food compartment comprising a temperature sensor disposed therein;

a temperature-controlled drawer positioned within the fresh food compartment; the temperature-controlled drawer including:

a display including a plurality of lights each indicative of a different storage temperature for the temperature-controlled drawer, and an input device for allowing a user to selectively illuminate the plurality of lights, wherein the temperature-controlled drawer is configured to have a temperature that is a predetermined temperature differential from a temperature in the fresh food compartment during steady state operation of the refrigerator; and a cooling system configured for introducing cold air into the fresh food compartment; and a controller for controlling the cooling system of the refrigerator, the controller configured to have at least two modes, wherein in a first mode the controller controls the cooling system to achieve a desired temperature within the fresh food compartment without respect to the temperature in the temperature-controlled drawer, in a second mode the controller controls the cooling system to achieve a desired temperature within the temperature-controlled drawer without respect to the temperature in the fresh food compartment, and a flow path for cold air flowing to the temperature-controlled drawer is free of a damper.

4. The refrigerator of claim 1, wherein the controller is disposed in the refrigerator.

5. The refrigerator of claim 1, wherein the predetermined temperature differential is about 0° C. to about 2° C.

6. The refrigerator of claim 1, wherein the controller is configured to transition to the second mode based on actuation of the input device.

7. The refrigerator of claim 1, wherein the controller is configured to remain in the second mode for a predetermined period of time.

8. The refrigerator of claim 1, wherein the controller is configured to transition from the second mode to the first mode based on receipt of a command from a user.

9. The refrigerator of claim 8, wherein the command from the user is a selection of a desired temperature for the fresh food compartment.

10. The refrigerator of claim 1, wherein the controller is configured to remain in the first mode for an indefinite period of time.

11. The refrigerator of claim 1, wherein each of the plurality of lights is a different color.

12. The refrigerator of claim 1, wherein the plurality of lights include a first light corresponding to a deli temperature, a second light corresponding to a dairy temperature and a third light corresponding to a meat temperature for the temperature-controlled drawer.

13. A method for controlling operation of a refrigerator, the refrigerator comprising a fresh food compartment for storing food, a temperature sensor disposed in the fresh food compartment, a temperature-controlled drawer positioned within the fresh food compartment, a cooling system configured for introducing cold air into the fresh food compartment, and a controller for controlling the cooling system of the refrigerator, the method comprising:

operating the controller in a first mode wherein the controller is configured to control the cooling system to achieve a desired temperature within the fresh food compartment without respect to a temperature in the temperature-controlled drawer, and upon actuation of an input device, transitioning the controller to a second mode wherein the controller is configured to control the cooling system to achieve a desired temperature within the temperature-controlled drawer based on the temperature sensor in the fresh food compartment and a predetermined temperature differential between the temperature in the fresh food compartment and in the temperature-controlled drawer, wherein a flow path for cold air flowing to the temperature-controlled drawer is free of a damper.

14. The method of claim 13, wherein the temperature-controlled drawer is configured to have a temperature that is a predetermined temperature differential from a temperature in the fresh food compartment during steady state operation of the refrigerator.

15. The method of claim 14, wherein the predetermined temperature differential is about 0° C. to about 2° C.

16. The method of claim 13, further comprising transitioning the controller from the second mode to the first mode after a predetermined period of time.

17. The method of claim 13, further comprising transitioning the controller from the second mode to the first mode upon command by a user.

18. The method of claim 17, wherein the command from the user is a selection of a desired temperature for the fresh food compartment.

19. The method of claim 13, wherein the controller is configured to remain in the first mode for an indefinite period of time.

20. The method of claim 13, wherein actuation of the input device indexes a display between a plurality of lights.

* * * * *